US010510284B2

(12) United States Patent
Hayashi et al.

(10) Patent No.: US 10,510,284 B2
(45) Date of Patent: Dec. 17, 2019

(54) DISPLAY DRIVER, ELECTRO-OPTIC APPARATUS, ELECTRONIC DEVICE, AND CONTROL METHOD FOR DISPLAY DRIVER

(71) Applicant: SEIKO EPSON CORPORATION, Tokyo (JP)

(72) Inventors: Haruo Hayashi, Shiojiri (JP); Akihiko Ito, Tatsuno-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/699,356

(22) Filed: Sep. 8, 2017

(65) Prior Publication Data

US 2018/0075796 A1 Mar. 15, 2018

(30) Foreign Application Priority Data

Sep. 9, 2016 (JP) ..... 2016-176055

(51) Int. Cl.
*G09G 3/36* (2006.01)
*G09G 3/20* (2006.01)

(52) U.S. Cl.
CPC ..... *G09G 3/2018* (2013.01); *G09G 3/3607* (2013.01); *G09G 3/3648* (2013.01); *G09G 3/3685* (2013.01); *G09G 3/3696* (2013.01); *G09G 2320/0242* (2013.01); *G09G 2320/0276* (2013.01); *G09G 2330/02* (2013.01); *G09G 2340/0435* (2013.01)

(58) Field of Classification Search
None
See application file for complete search history.

(56) References Cited

U.S. PATENT DOCUMENTS

| | | | | |
|---|---|---|---|---|
| 5,784,041 | A | 7/1998 | Okada et al. | |
| 7,006,114 | B2 | 2/2006 | Sakaguchi | |
| 7,071,669 | B2 | 7/2006 | Morita | |
| 8,184,078 | B2 | 5/2012 | Bu et al. | |
| 2002/0145581 | A1* | 10/2002 | Kudo | G09G 3/3685 345/89 |
| 2005/0052477 | A1* | 3/2005 | Kudo | G09G 3/2011 345/690 |
| 2006/0198009 | A1* | 9/2006 | Morita | G09G 3/3648 359/245 |

(Continued)

FOREIGN PATENT DOCUMENTS

| | | | |
|---|---|---|---|
| JP | H09-258695 | A | 10/1997 |
| JP | 2003-023354 | A | 1/2003 |

(Continued)

*Primary Examiner* — Parul H Gupta
(74) *Attorney, Agent, or Firm* — Oliff PLC

(57) ABSTRACT

A display driver includes a drive circuit that receives input of a first reference voltage to an nth reference voltage (where n is an integer of two or more), and outputs a drive voltage that is based on a grayscale voltage obtained by voltage division of an ith reference voltage and an (i+1)th reference voltage (where i is an integer of n−1 or less), and a control circuit that utilizes frame rate control on first display data corresponding to a grayscale voltage obtained by voltage division of the first reference voltage and a second reference voltage to generate second display data, and supplies the second display data to the drive circuit.

10 Claims, 15 Drawing Sheets

(56) References Cited

U.S. PATENT DOCUMENTS

| | | | | |
|---|---|---|---|---|
| 2008/0150866 | A1* | 6/2008 | Maki | G09G 3/3688 345/89 |
| 2009/0040158 | A1 | 2/2009 | Chuang | |
| 2010/0182300 | A1* | 7/2010 | Kato | G09G 3/3685 345/211 |

FOREIGN PATENT DOCUMENTS

| | | | |
|---|---|---|---|
| JP | 2003-280596 | A | 10/2003 |
| JP | 2009-145492 | A | 7/2009 |

* cited by examiner

| GRADATION | GRADATION VOLTAGE |
|---|---|
| 0 | $V_0$ |
| 1 | $V_1$ |
| 2 | $V_2$ |
| 3 | $V_3$ |
| ⋮ | ⋮ |
| 255 | $V_{255}$ |

NTH GRADATION

| | SETTING 1 | SETTING 2 | SETTING 3 | SETTING 4 | SETTING 5 | SETTING 6 | SETTING 7 |
|---|---|---|---|---|---|---|---|
| 1frame | N−1 | N−1 | N−1 | N | N | N | N |
| 2frame | N−1 | N−1 | N | N | N | N | N+1 |
| 3frame | N−1 | N | N | N | N | N+1 | N+1 |
| 4frame | N | N | N | N | N+1 | N+1 | N+1 |

FIG. 10

| GRADATION | 0 | 1 | 2 | 3 | 4 | 5 | | 251 | 252 | 253 | 254 | 255 |
|---|---|---|---|---|---|---|---|---|---|---|---|---|
| 1frame | $V_0$ | $V_1$ | $V_2$ | $V_3$ | $V_4$ | $V_5$ | | $V_{250}$ | $V_{252}$ | $V_{252}$ | $V_{253}$ | $V_{255}$ |
| 2frame | $V_0$ | $V_2$ | $V_2$ | $V_3$ | $V_4$ | $V_5$ | ··· | $V_{250}$ | $V_{252}$ | $V_{252}$ | $V_{253}$ | $V_{255}$ |
| 3frame | $V_0$ | $V_2$ | $V_3$ | $V_3$ | $V_4$ | $V_5$ | | $V_{250}$ | $V_{252}$ | $V_{253}$ | $V_{253}$ | $V_{255}$ |
| 4frame | $V_0$ | $V_2$ | $V_3$ | $V_4$ | $V_4$ | $V_5$ | | $V_{250}$ | $V_{252}$ | $V_{253}$ | $V_{254}$ | $V_{255}$ |

FIG. 11

DISPLAY DRIVER, ELECTRO-OPTIC APPARATUS, ELECTRONIC DEVICE, AND CONTROL METHOD FOR DISPLAY DRIVER

CROSS-REFERENCE TO RELATED APPLICATIONS

The present application claims priority to Japanese Patent Application JP 2016-176055, filed Sep. 9, 2016, the entire disclosure of which is hereby incorporated by reference herein.

BACKGROUND

1. Technical Field

The present invention relates to a display driver, an electro-optic apparatus, an electronic device, a control method for the display driver, and the like.

2. Related Art

Currently, color liquid crystal panels (display panels) are often used in electronic devices such as monitors, TVs and laptop PCs. With a color liquid crystal panel, each pixel is constituted by R, G and B subpixels, for example, and one color is represented with one pixel as a whole, by the combination of colors of the R, G and B subpixels. The colors of the R, G and B subpixels are determined by the luminance of light that passes through color filters respectively provided on the subpixels. The luminance of light that passes through each color filter is decided by the voltage that is supplied to a source electrode (data line) of the liquid crystal panel. This voltage is called a grayscale voltage. A display driver that includes a circuit apparatus that drives the liquid crystal panel by controlling the grayscale voltage is provided in an electronic device.

Generally, the inputs (input voltage, input signal, etc.) and outputs (light transmittance, brightness, etc.) of a liquid crystal panel are not in a linearly direct proportion relationship. Due to factors such as variation in the liquid crystal materials that are used for liquid crystal panels and variation in production, liquid crystal panels each have unique gamma characteristics (luminance characteristics). Thus, it is necessary to supply grayscale voltages that take account of the gamma characteristics of each liquid crystal panel to the source electrode of the liquid crystal panel to enable desired gradations to be represented.

For example, JP-A-09-258695 discloses a conventional technology that generates 256 interpolation voltages, by dividing nine grayscale voltages (V0, V32, . . . , V256) equally using fixed resistors. By performing voltage division with fixed resistors, circuit size can be reduced.

Even in the same liquid crystal panel, gamma characteristics (gamma values) may differ depending on the gradation. In particular, in a liquid crystal panel, deviation often occurs in the gamma values with gradations of a low gradation region or a high gradation region, compared with other gradations. Thus, in the case where the gamma values differ for each gradation, the liquid crystal panel is not able to, for instance, represent smooth changes in hue in the area around the point at which the gamma values change. Also, this often appears to the user in the form of tone jump, color shift or color cast.

SUMMARY

According to some aspects of the invention, a display driver, an electro-optic apparatus, an electronic device, a control method for the display driver and the like that are able to suppress deviation in gamma values between different gradations in a display panel can be provided.

One aspect of the invention relates to a display driver including a drive circuit that receives input of a first reference voltage to an nth reference voltage (where n is an integer of two or more), and outputs a drive voltage that is based on a grayscale voltage obtained by voltage division of an ith reference voltage and an (i+1)th reference voltage (where i is an integer of n−1 or less), and a control circuit that utilizes frame rate control on first display data corresponding to a grayscale voltage obtained by voltage division of the first reference voltage and a second reference voltage to generate second display data, and supplies the second display data to the drive circuit.

In the above aspect of the invention, a control circuit utilizes frame rate control on first display data corresponding to a grayscale voltage obtained by voltage division of a first reference voltage and a second reference voltage to generate second display data, and supplies the second reference voltage to a drive circuit. The drive circuit then outputs a drive voltage, based on the second display data. Therefore, it becomes possible, in a display panel, to suppress deviation in gamma values between different gradations.

Also, in the above aspect of the invention, the drive circuit may output a drive voltage that is based on the second display data, in a case of outputting a drive voltage that is based on the grayscale voltage obtained by voltage division of the first reference voltage and the second reference voltage.

With gradations on the low gradation region side, for example, it thereby becomes possible to, for instance, drive the display panel, in accordance with the frame rate control of the control circuit.

Also, in the above aspect of the invention, the control circuit may utilize the frame rate control on first display data corresponding to a grayscale voltage obtained by voltage division of an (n−1)th reference voltage and the nth reference voltage to generate the second display data, and supply the second display data to the drive circuit.

In a display panel, for example, it thereby becomes possible to, for instance, suppress deviation in the gamma values on the high gradation region side, and to improve color reproducibility and gradation on the high gradation region side.

Also, in the above aspect of the invention, the drive circuit may output the drive voltage that is based on the second display data, in a case of outputting a drive voltage that is based on the grayscale voltage obtained by voltage division of the (n−1)th reference voltage and the nth reference voltage.

With gradations on the high gradation region side, for example, it thereby becomes possible to, for instance, drive the display panel, in accordance with the frame rate control of the control circuit.

Also, in the above aspect of the invention, the control circuit may include a look-up table circuit that outputs the second display data, based on a look-up table to which the first display data is input.

It thereby becomes possible to, for instance, drive the display panel, with a different modulation pattern for every gradation, for example.

Also, another aspect of the invention relates to an electro-optic apparatus including the above display driver.

Also, yet another aspect of the invention relates to an electronic device including the above display driver.

Also, a further aspect of the invention relates to a control method for a display driver, the method utilizing frame rate control on first display data corresponding to a grayscale voltage obtained by voltage division of a first reference voltage and a second reference voltage, out of the first reference voltage to an nth reference voltage (where n is an integer of two or more), to generate second display data, and outputting a drive voltage that is based on the second display data, in a case of outputting a drive voltage that is based on the grayscale voltage obtained by voltage division of the first reference voltage and the second reference voltage.

Also, in the further of the invention, the frame rate control may be utilized on first display data corresponding to a grayscale voltage obtained by voltage division of an (n−1)th reference voltage and the nth reference voltage to generate the second display data, and the drive voltage that is based on the second display data may be output, in a case of outputting a drive voltage that is based on the grayscale voltage obtained by voltage division of the (n−1)th reference voltage and the nth reference voltage.

BRIEF DESCRIPTION OF THE DRAWINGS

The invention will be described with reference to the accompanying drawings, wherein like numbers reference like elements.

FIG. 10 is an explanatory diagram of modulation patterns that are settable in a look-up table.

FIG. 11 is an explanatory diagram of an example of a look-up table.

DESCRIPTION OF EXEMPLARY EMBODIMENTS

Hereinafter, embodiments of the invention will be described. Note that the embodiments that will be described below are not intended to unduly limit the contents of the invention as defined in the claims. Also, not all configurations that are described in the embodiments are essential constituent elements of the invention.

1. Outline

As aforementioned, even with the same liquid crystal panel, the gamma characteristics (gamma values) of gradations in a low gradation region or a high gradation region may differ from other gradations. Thus, in the case where the gamma values differ for every gradation, the liquid crystal panel is not able to, for instance, represent smooth changes in hue in the area around the point at which the gamma values change, and this often appears to the user in the form of tone jump, color shift or color cast.

In the embodiment that will be described below, frame rate control is utilized on gradations whose gamma values differ from other gradations to control the grayscale voltage, for example, and deviation in the gamma values from other gradations is suppressed.

Figures 1, 2:
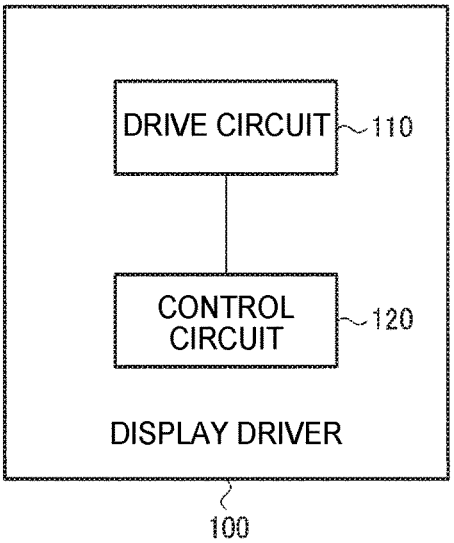
FIG. 1 is a configuration diagram of a display driver of an embodiment.
FIG. 2 is a correspondence relationship diagram of gradation and grayscale voltage.

Specifically, a configuration diagram of a display driver 100 of this embodiment is shown in FIG. 1. As shown in FIG. 1, the display driver 100 of this embodiment includes a drive circuit 110 and a control circuit 120.

Figure 22:
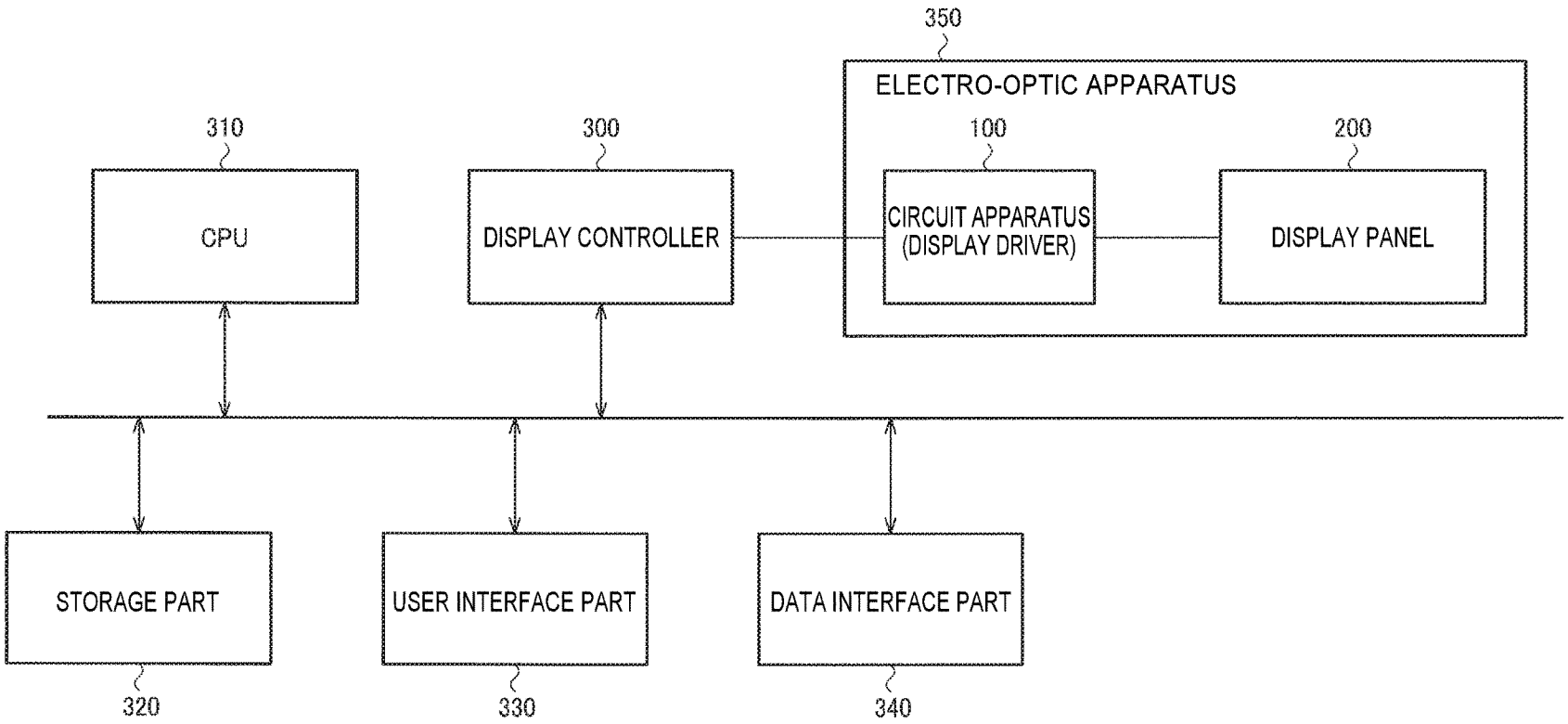
FIG. 22 is an explanatory diagram of exemplary configurations of an electronic device and electro-optic apparatus.

The drive circuit 110 receives input of a first reference voltage to an nth reference voltage (where n is an integer of two or more), and outputs drive voltages that are based on grayscale voltages obtained by voltage division of an ith reference voltage and a (i+1)th reference voltage (where i is an integer of n−1 or less). For example, the drive circuit 110 is connected to a display panel such as shown in FIG. 22 which will be discussed later, and outputs the drive voltages to this display panel 200.

The control circuit 120 executes processing for frame rate control. Specifically, the control circuit 120 utilizes frame rate control on first display data corresponding to a grayscale voltage obtained by voltage division of a first reference voltage and a second reference voltage to generate second display data (generate second display data by frame rate control), and supplies the generated second display data to the drive circuit 110. As will be discussed in detail later using FIG. 3, the control circuit 120 acquires display data (first display data) that is input from outside, via an interface part 10. The control circuit 120 then performs gradation control that utilizes frame rate control, based on the acquired display data (first display data), and outputs display data (second display data) obtained after frame rate control to the drive circuit 110. The control circuit 120 is connected to the drive circuit 110. Note that, hereinafter, for simplification of description, the first display data input from outside, for instance, and the second display data generated utilizing frame rate control will be simply referred to as display data as appropriate.

Here, a reference voltage is a voltage that is used in order to generate a grayscale voltage. Specifically, the voltages of connection nodes of respective variable resistance circuits that are included in a ladder resistance circuit 34 which will be discussed later using FIG. 4 and FIG. 5, for example, correspond to respective reference voltages. In this embodiment, the grayscale voltage is generated, based on at least two reference voltages, out of these plurality of reference voltages.

Also, the first reference voltage and the second reference voltage, out of the first reference voltage to the nth reference voltage, are reference voltages for generating grayscale voltages on the low gradation region side (or the high gradation region side), for example.

For example, in the case of displaying gradations from 0 to 255, grayscale voltages (V0 to V255) respectively corresponding to the gradations from 0 to 255 are defined, as shown in FIG. 2. The drive circuit 110 then performs voltage division of the first reference voltage and the second reference voltage to generate grayscale voltages V0 to V3, for example, as will be discussed later using FIG. 4.

Also, display data (second display data) obtained after frame rate control is display data that is output to the drive circuit 110 after the control circuit 120 has performed gradation control through frame rate control, when displaying gradations that are indicated by the display data acquired by the control circuit 120 on the display panel. For example, in an example shown in FIG. 11 which will be discussed later, in the case where the gradation 1 is input to the control circuit 120 as display data, frame rate control is performed, and in the first frame, display data for causing the grayscale voltage V1 corresponding to the gradation 1 to be output is output to the drive circuit 110, and in the second frame to the fourth frame, display data for causing the grayscale voltage V2 corresponding to the gradation 2 to be output is output to the drive circuit 110. Here, the display data that is output to the drive circuit 110 after such frame rate control will be called post-frame rate control display data. The post-frame rate control display data can also be said to be data that instructs the drive circuit 110 as to the grayscale voltages of the gradations that are to be output as drive voltages to the display panel and the output timing. To put it another way, the post-frame rate control display data (second display data generated utilizing frame rate control) is display data that has been modulated as a result of the frame rate control. The drive circuit 110 outputs drive voltages to the display panel, based on the acquired post-frame rate control display data.

The output pattern of grayscale voltages for correcting deviation in the gamma values between gradations can thereby be determined, when displaying gradations that are indicated by the display data input to the control circuit 120 on the display panel. Therefore, it becomes possible, on the display panel, to suppress deviation in the gamma values between different gradations. As a result, it becomes possible, on the display panel, to improve color reproducibility and gradation and to represent smooth changes in hue, for instance. In particular, in the above example, color reproducibility and gradation on the low gradation region side (dark portion side) can be improved. Note that eliminating deviation in the gamma characteristics of gradations on the low gradation region side (dark portion side) will be discussed later using FIG. 12.

Also, the drive circuit 110 outputs drive voltages that are based on display data (second display data) obtained as a result of performing frame rate control, in the case of outputting a drive voltage that is based on a grayscale voltage obtained by voltage division of the first reference voltage and the second reference voltage.

Specifically, description will be given using the aforementioned FIG. 11. First assume that data indicating the gradation 1 is input to the control circuit 120 as display data. In this case, the control circuit 120, in the first frame, outputs display data of the gradation 1 to the drive circuit 110, and, in the second frame to the fourth frame, outputs display data of the gradation 2 to the drive circuit 110. The drive circuit 110 then performs voltage division of the first reference voltage and the second reference voltage, and, in the first frame, outputs a grayscale voltage V1 corresponding to display data of the gradation 1 to the display panel as the drive voltage, and, in the second frame to the fourth frame, outputs a grayscale voltage V2 corresponding to display data of the gradation 2 to the display panel as the drive voltage.

With gradations on the low gradation region side, for example, it thereby becomes possible to, for instance, drive the display panel, in accordance with the frame rate control by the control circuit 120.

It is also possible to perform similar processing with gradations on the high gradation region side (or the low gradation region side). In other words, the control circuit 120 performs frame rate control on display data (first display data) corresponding to grayscale voltages obtained by voltage division of the (n−1)th reference voltage and the nth reference voltage (utilizes frame rate control to generate second display data), and supplies the generated second display data to the drive circuit 110.

Here, the (n−1)th reference voltage and the nth reference voltage, out of the first reference voltage to the nth reference voltage, are reference voltages for generating grayscale voltages on the high gradation region side (or the low gradation region side), for example. For example, as shown in FIG. 2, in the case of displaying the gradations from 0 to 255, the drive circuit 110 performs voltage division of the (n−1)th reference voltage and the nth reference voltage to generate grayscale voltages V252 to V255 (here, n=64), for example. The control circuit 120, in the case where display data indicating gradations (252 to 255) corresponding to these grayscale voltages V252 to V255 is input, then performs frame rate control to supply display data to the drive circuit 110. For example, in the example shown in FIG. 11 which will be discussed later, in the case where display data of the gradation 253 is input, display data indicating the gradation 252 is output to the drive circuit 110 in the first frame and the second frame. Display data indicating the gradation 253 is then output to the drive circuit 110 in the third frame and the fourth frame.

It thereby becomes possible to, for instance, determine the output pattern of grayscale voltages for correcting deviation in the gamma values between gradations, when displaying gradations on the high gradation region side on the display panel, for example. Therefore, it becomes possible, on the display panel, to suppress deviation in the gamma values on the high gradation region side, and to improve color reproducibility and gradation on the high gradation region side, for instance. Note that eliminating deviation in the gamma characteristics of gradations on the high gradation region side will be discussed later using FIG. 13.

Also, the drive circuit 110 outputs drive voltages that are based on display data (second display data) obtained as a result of performing frame rate control, in the case of outputting drive voltages that are based on grayscale voltages obtained by voltage division of the (n−1)th reference voltage and the nth reference voltage.

Description will also be given similarly in this case using the aforementioned FIG. 11. First assume that data indicating the gradation 253 is input to the control circuit 120 as display data. In this case, as aforementioned, the control circuit 120, in the first frame and the second frame, outputs display data of the gradation 252 to the drive circuit 110, and, in the third frame and the fourth frame, outputs display data of the gradation 253 in the drive circuit 110. The drive circuit 110 then performs voltage division of the (n−1)th reference voltage and the nth reference voltage, and, in the first frame and the second frame, outputs the grayscale voltage V252 corresponding to display data of the gradation 252 to the display panel as the drive voltage, and, in the third frame and the fourth frame, outputs the grayscale voltage V253 corresponding to display data of the gradation 253 to the display panel as the drive voltage.

With gradations on the high gradation region side, for example, it thereby becomes possible to, for instance, drive the display panel, in accordance with the frame rate control of the control circuit 120.

2. Display Driver

Figure 3:
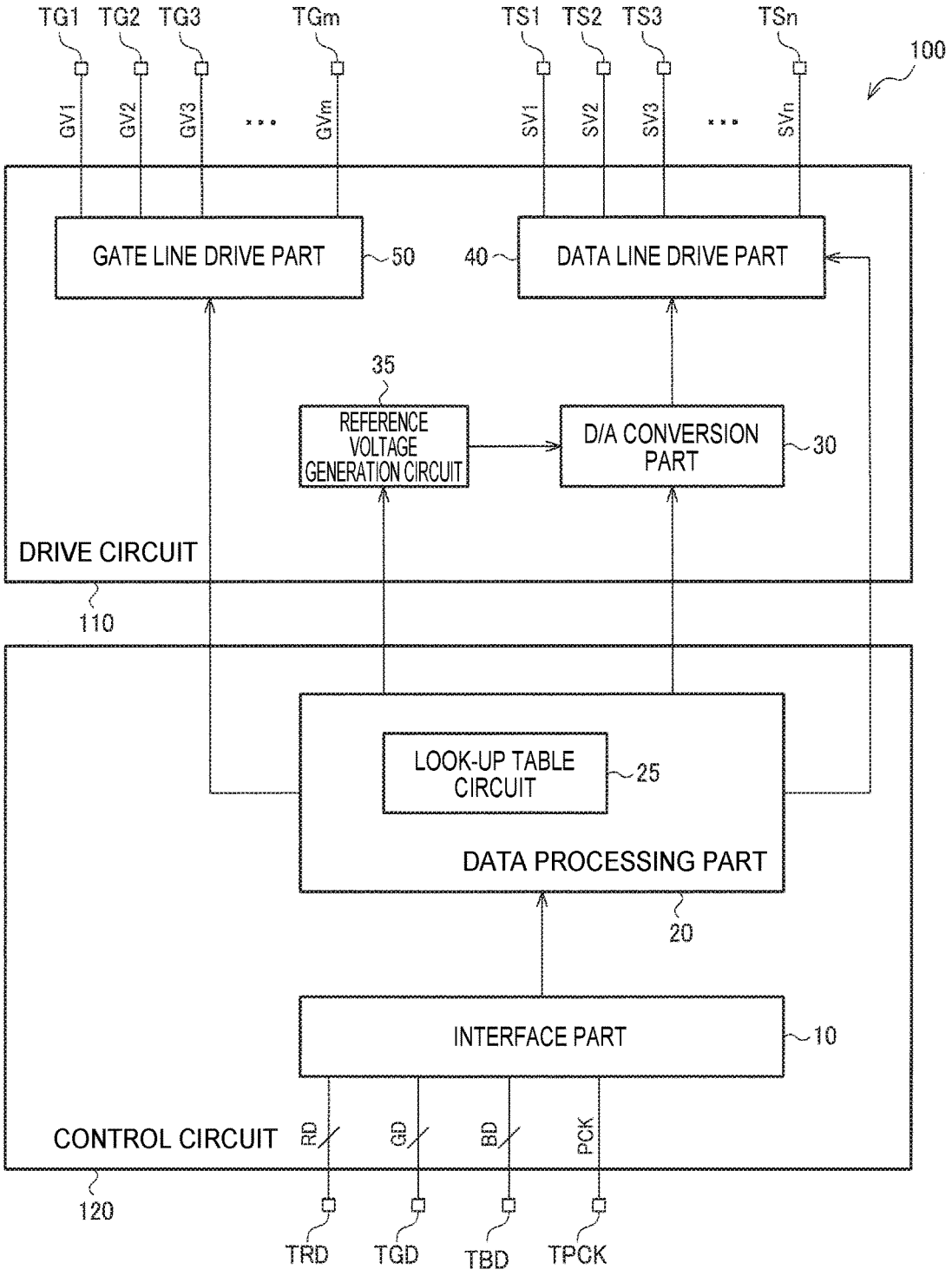
FIG. 3 is an explanatory diagram of a detailed exemplary configuration of the display driver of the embodiment.

FIG. 3 shows an exemplary configuration of the display driver 100 of this embodiment. As shown in FIG. 3, the display driver 100 includes the drive circuit 110 and the control circuit 120.

The drive circuit 110 includes a reference voltage generation circuit 35 (grayscale voltage generation circuit, gamma correction circuit), a D/A conversion part 30 (D/A conversion circuit), a data line drive part 40 (data line drive circuit), and a gate line drive part 50 (gate line drive circuit). The data line drive part 40 (data line drive circuit) includes data line drive terminals (data line drive signal output terminals) TS1 to TSn (where n is an integer of two or more). Also, the gate line drive part 50 (gate line drive circuit) includes gate line drive terminals TG1 to TGm (where m is an integer of two or more).

The control circuit 120 includes the interface part 10 (interface circuit or terminal) and a data processing part 20 (data processing circuit).

The display driver 100 is realized by an integrated circuit apparatus (IC), for instance. Note that the display driver 100 is not limited to the configuration of FIG. 3, can be variously modified, such as by omitting some of these constituent elements or adding other constituent elements.

The interface part 10 performs communication with an external processing apparatus (display controller; e.g., MPU, CPU, ASIC, etc.). The interface part 10 has a first color component input terminal TRD, a second color component input terminal TGD, a third color component input terminal TBD, and a clock input terminal TPCK. Communication involves transfer of image data, supply of clock signals and synchronization signals, and transmission of commands (or control signals), for example. Also, the interface part 10 accepts terminal settings (input levels of terminals set on a mounting board). The interface part 10 is constituted by an I/O buffer and the like, for example.

The data processing part 20 performs data processing of image data, timing control, control of each part of the display driver 100, and the like, based on image data, clock signals, synchronization signals, commands and the like input via the interface part 10. Also, the data processing part 20 includes a look-up table circuit 25, and performs gradation control, by frame rate control that uses the look-up table circuit 25. In data processing of image data, image processing such as processing for correcting gradations that are indicated by color component display data such as the first color component display data, the second color component display data and the third color component display data, for example, is performed. In the timing control, the drive timing (selection timing) of gate lines and the drive timing of data lines of the display panel is controlled based on synchronization signals and image data. The data processing part 20 is constituted by a logic circuit such as a gate array, for example.

The look-up table circuit 25 outputs display data (second display data) obtained as a result of performing frame rate control, based on the look-up table to which the display data (first display data) is input. An example of a look-up table will be discussed later using FIG. 10 and FIG. 11.

It thereby becomes possible to, for instance, drive the display panel, with a different modulation pattern for every gradation, for example. The present embodiment is, however, not limited to the example that uses a look-up table circuit. For example, the data processing part 20 may perform frame rate control, by computation, based on display data to output post-frame rate control display data.

Next, the reference voltage generation circuit 35 generates a plurality of reference voltages, and outputs the generated reference voltages to the D/A conversion part 30. For example, in the example of FIG. 4 which will be discussed later, VR0 to VR63 are generated as the plurality of reference voltages. A plurality of grayscale voltages are then generated, based on these reference voltages VR0 to VR63. For example, as shown in the table of FIG. 2, each of the grayscale voltages (V0 to V255) that are generated corresponds to a different gradation (0 to 255) of the plurality of gradations. Also, in this embodiment, since the reference voltage that is output from the reference voltage generation circuit 35 is shared when displaying a plurality of color component display data (e.g., first color component display data, second color component display data, third color component display data, etc.), it is not necessary to provided the reference voltage generation circuit 35 for every pieces of color component display data. Thus, by employing a configuration that shares the plurality of reference voltages with the first color component display data, the second color component display data and the third color component display data, the circuit area of the reference voltage generation circuit 35 can be reduced and the wiring area of the reference voltage line can be reduced, enabling miniaturization of the display driver to be realized. The reference voltage generation circuit 35 may, however, be provided for every color.

Figure 4:
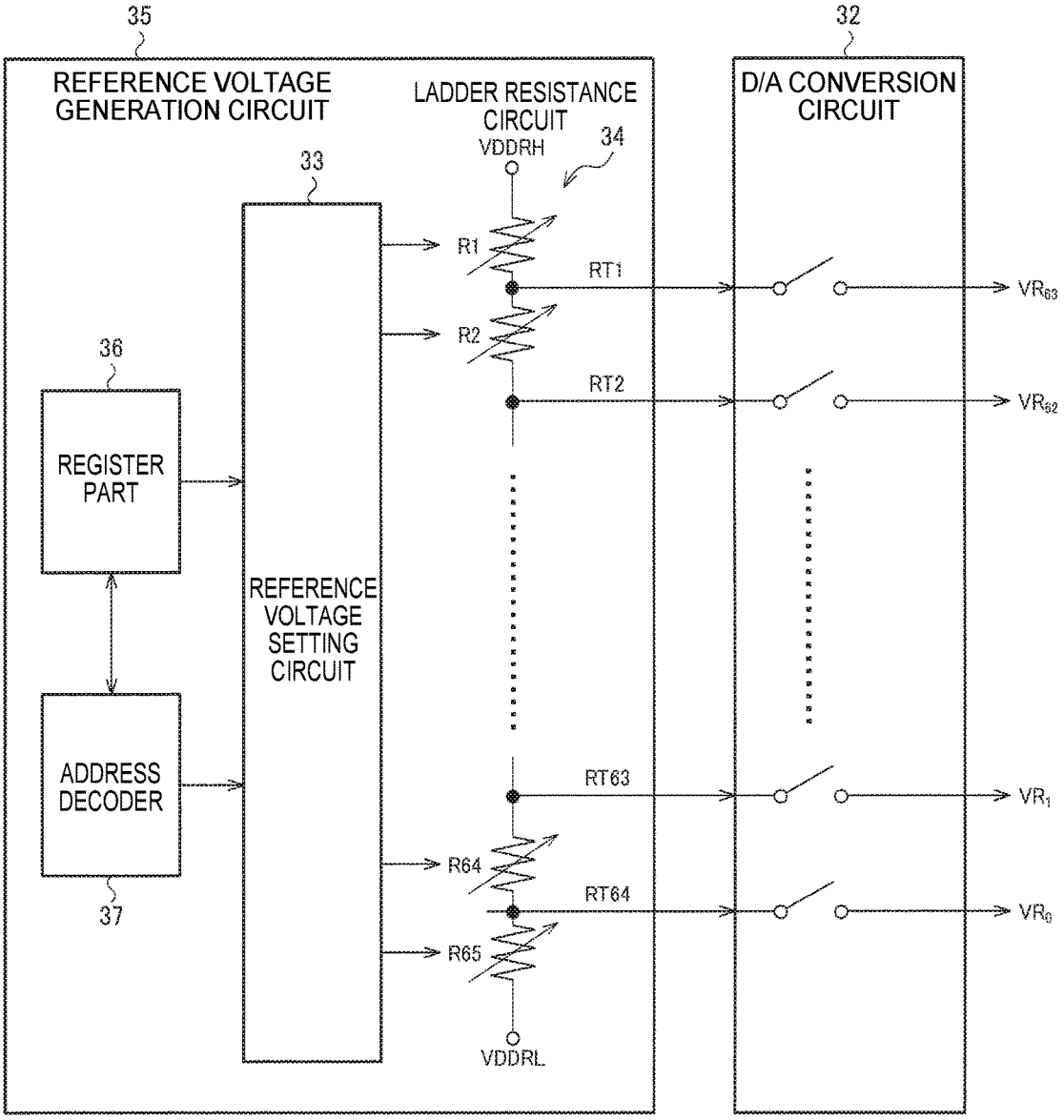
FIG. 4 is an explanatory diagram of specific exemplary configurations of a reference voltage generation circuit and a D/A conversion circuit.

The D/A conversion part 30D/A converts image data (input gradations) from the data processing part 20 into reference voltages (data voltages). For example, the D/A conversion part 30 includes a D/A conversion circuit 32 (plurality of voltage selection circuits) shown in FIG. 4. As shown in FIG. 4 which will be discussed later, for example, the reference voltage generation circuit 35 is constituted by a ladder resistor and the like, and the D/A conversion circuit 32 is constituted by a switch circuit and the like. The specific configuration of the reference voltage generation circuit 35 and the D/A conversion circuit 32 will be discussed in detail later using FIG. 4 and FIG. 5.

The drive circuit 110 drives the display panel, based on first color component display data, second color component display data and third color component display data after data processing that are obtained from the data processing part 20, and a plurality of grayscale voltages used in common with respect to first color component display data, second color component display data and third color component display data that are obtained from the reference voltage generation circuit 35.

The data line drive part 40 of the drive circuit 110 generates grayscale voltages, based on reference voltages from the D/A conversion part 30. The data line drive part 40 then outputs the generated grayscale voltages to the data line drive terminals TS1 to TSn as data line drive voltages SV1 to SVn, and drives the data lines of the display panel. The data line drive voltages SV1 to SVn are voltages that are supplied to the corresponding data line drive terminals TS1 to TSn. The grayscale voltages are generated by performing voltage division of the reference voltages that are input from the D/A conversion part 30, based on post-frame rate control display data that is input from the data processing part 20 of the control circuit 120. As each voltage of the data line drive voltages SV1 to SVn, one voltage among of the generated grayscale voltages (e.g., V0 to V255) is then selected by the data line drive part 40 based on the image data.

Also, the data line drive part 40 includes a plurality of data line drive circuits. Each data line drive circuit is provided in correspondence with one data line drive terminal or a plurality of data line drive terminals. In the case where each data line drive circuit is provided in correspondence with a plurality of data line drive terminals, that data line drive circuit drives a plurality of data lines in time division. The gate line drive part 50 of the drive circuit 110 outputs gate line drive voltages GV1 to GVm to the gate line drive terminals TG1 to TGm, and drives (selects) the gate lines of the display panel. For example, with a single gate display panel, one gate line is selected in one horizontal scanning period. Alternatively, with a dual gate or triple gate display panel, two or three gate lines are selected in time division in one horizontal scanning period. The gate line drive part 50 is constituted by a plurality of voltage output circuits (buffer, amplifier), for example, and one voltage output circuit is provided in correspondence with each gate line drive terminal, for example.

3. Reference Voltage Generation Circuit and D/A Conversion Circuit

FIG. 4 shows an exemplary configuration of the reference voltage generation circuit 35 and the D/A conversion circuit 32. This reference voltage generation circuit 35 includes a reference voltage setting circuit 33, a ladder resistance circuit 34, a register part 36, and an address decoder 37. Also, the D/A conversion circuit 32 is constituted by a switch circuit and the like.

Here, the ladder resistance circuit 34 performs resistance division between a high potential side power source (power source voltage) VDDRH and a low potential side power source (power source voltage) VDDRL using 65 variable resistance circuits (R65-R1), for example, and outputs each grayscale voltage of a plurality of reference voltages VR0 to VR63 to a different resistance division node of a plurality of resistance division nodes RT64 to RT1. Note that, in the following description, the case of 256 gradations will be described, similarly to the above, but this embodiment is not limited thereto.

Gradation adjustment data (data for adjusting the gradation characteristics) from the data processing part 20 (logic circuit) is then written to the register part 36. The address decoder 37 decodes address signals from the logic circuit, and outputs register address signals corresponding to the address signals. In the register part 36, gradation adjustment data is written to registers whose register address signal from the address decoder 37 is active, based on latch signals from the logic circuit.

The reference voltage setting circuit 33 (gradation selector) variably sets (controls) the reference voltages that are output to the resistance division nodes RT1 to RT64, based on the gradation adjustment data written to the register part 36. Specifically, reference voltages are variably set, by variably controlling the resistance values of the plurality of variable resistance circuits (R1 to R64) that are included in the ladder resistance circuit 34. The reference voltages can thereby be adjusted to a voltage suitable for the gamma characteristics of each display panel.

Figure 6:
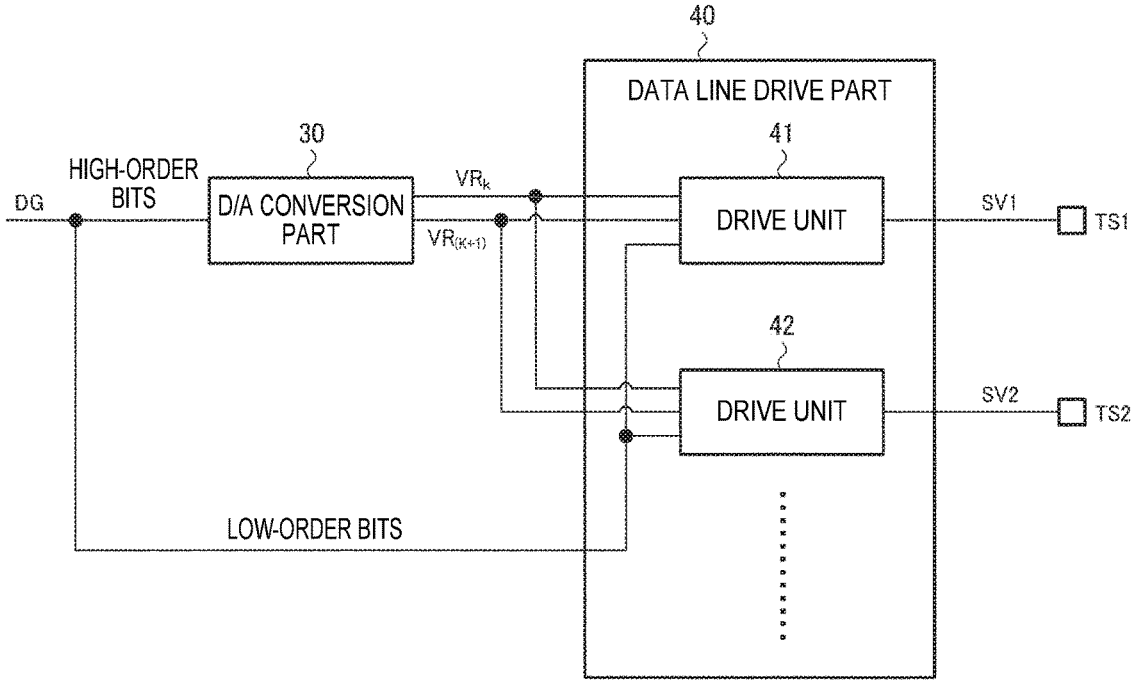
FIG. 6 is an explanatory diagram of an exemplary configuration of a data line drive part.

Also, the D/A conversion circuit 32 performs ON/OFF control of the switch circuit based on the image data, selects reference voltages required in order to display the image data, from among the plurality of reference voltages VR0 to VR63 that are output from the reference voltage generation circuit 35, and outputs the selected reference voltages to the data line drive part 40. At this time, as shown in FIG. 6 which will be discussed later, high-order bits of display data DG are input from the data processing part 20, and the D/A conversion circuit 32 selects reference voltages, based on the high-order bits of this display data DG.

Note that the reference voltage generation circuit and the D/A conversion circuit are not limited to the configurations of FIG. 4, and can be variously modified, such as by omitting some of the constituent elements of FIG. 4 or adding other constituent elements. For example, a ladder resistance circuit for positive polarity and the ladder resistance circuit for negative polarity may be provided, or a circuit (op-amp of voltage follower connection) that performs impedance conversion of grayscale voltage signals may be provided. Alternatively, a voltage generation circuit for use in selection and a reference voltage selection circuit may be included in the reference voltage generation circuit. In this case, voltages divided by a ladder resistance circuit that is included in the voltage generation circuit for use in selection are output as a plurality of voltage for use in selection. The reference voltage selection circuit then selects 64 (broadly, S) voltages in the case of 256 gradations, for example, according to gradation adjustment data, from among the voltages for use in selection from the voltage generation circuit for use in selection, and outputs the selected voltages as reference voltages VR0 to VR63.

Figure 7:
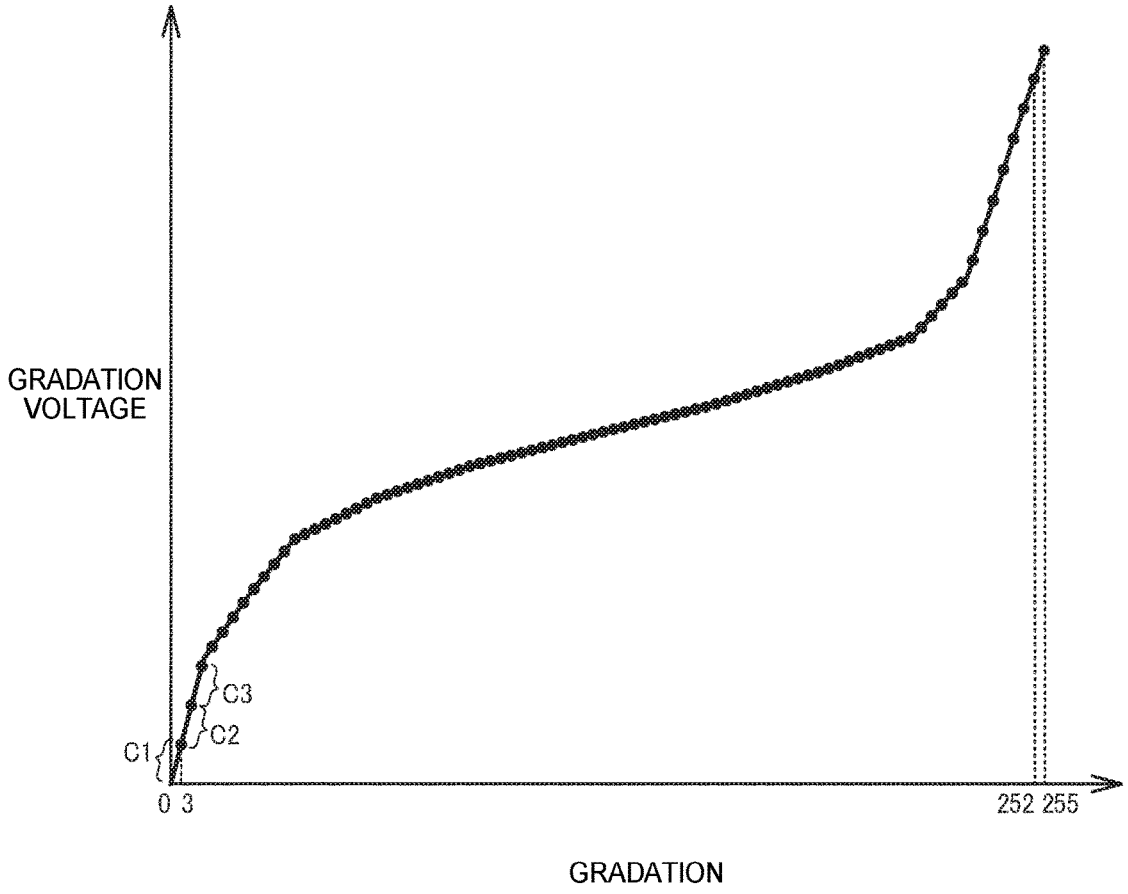
FIG. 7 is an explanatory diagram of gradation characteristics.

In the reference voltage generation circuit 35 of FIG. 4, the gradation characteristics are adjusted, by variably controlling the slope of the gradation characteristics in each segment shown by C1, C2, C3 and the like in FIG. 7. Controlling the slope of the gradation characteristics in each of these segments can be realized by controlling the resistance values of the variable resistance circuits of the ladder resistance circuit 34 respectively corresponding to these segments.

Figure 5:
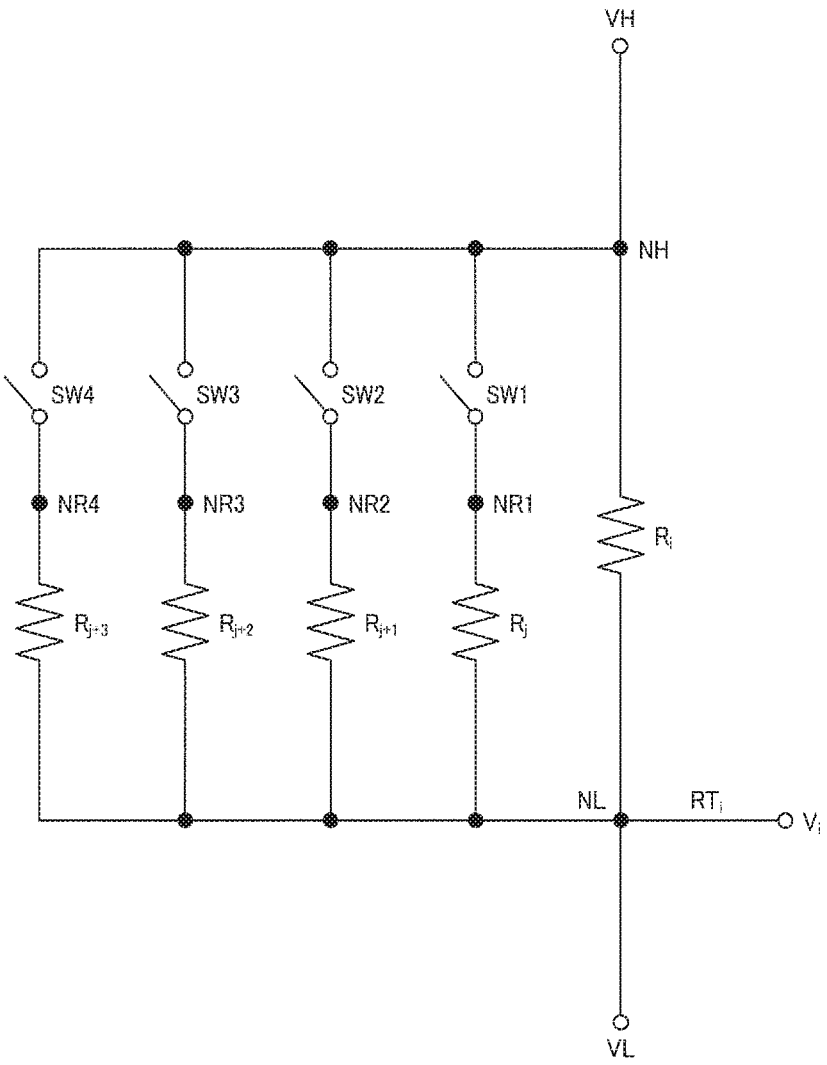
FIG. 5 is an explanatory diagram of a variable resistance circuit that is included in the reference voltage generation circuit.

Next, an exemplary configuration of the variable resistance circuits that are included in the ladder resistance circuit 34 is shown in FIG. 5. In the ladder resistance circuit 34, a plurality of variable resistance circuits having the configuration shown in FIG. 5 are provided in series between the high potential side power source VDDRH and the low potential side power source VDDRL. VH in FIG. 5 is a node on the high potential side power source VDDRH side, and VL is a node on the low potential side power source VDDRL side.

In FIG. 5, a resistor Ri is provided between NH which is a connection node connecting to an upper (upstream) variable resistance circuit and NL which is a connection node connecting to a lower (downstream) variable resistance circuit.

Also, switching elements SW1, SW2, SW3 and SW4 that are constituted by transistors are provided between the node NH and the node NL. Also, resistors Rj, Rj+1, Rj+2 and Rj+3 for use in adjustment are provided between the nodes NR1 and NL, between the nodes NR2 and NL, between the nodes NR3 and NL, and between the nodes NR4 and NL. The connection node NL becomes a resistance division node RTi, and the reference voltage Vi is generated in this resistance division node RTi and output.

In FIG. 5, the total resistance value between the nodes NH and NL changes, as a result of performing ON/OFF control of the switching elements SW1 to SW4. For example, in the case where the switching elements SW1 to SW4 are all OFF, the total resistance value between the nodes NH and NL will be Ri. On the other hand, when only the switching element SW1 is turned ON, the total resistance value between the nodes NH and NL will be a parallel resistance value of Ri and Rj. Also, when only the switching element SW2 is turned ON, the total resistance will be a parallel resistance value of Ri and Rj+1.

Thus, when ON/OFF control of the switching elements SW1 to SW4 is performed and the total resistance value between the nodes NH and NL changes, the slope of the gradation characteristics in FIG. 7 corresponding to the segment of that variable resistance circuit changes. The gradation characteristics can thereby be variably controlled. In this case, the reference voltage setting circuit 33 of FIG. 4 generates a switching signal for performing ON/OFF control of the switching elements SW1 to SW4, based on the gradation adjustment data written to the register part 36, and outputs the switching signal to the ladder resistance circuit 34.

4. Generation of Grayscale voltages by Data Line Drive Unit

Next, generation of grayscale voltages will be described using FIG. 6. As aforementioned, the high-order bits of the display data DG are input to the D/A conversion part 30. The high-order bits of this display data DG are data indicating which reference voltages to use, in order to generate the grayscale voltages, out of the plurality of reference voltages (VR0 to VR63) generated by the reference voltage generation circuit 35 shown in FIG. 4. In this example, the D/A conversion part 30 selects at least two reference voltages, among the plurality of reference voltages, based on the high-order bits of the display data DG. For example, when displaying gradations on the low gradation region side on the display panel, the D/A conversion part 30 selects VR0 and VR1 as the reference voltages, and outputs the selected reference voltages to the data line drive part 40.

Also, the data line drive part 40 has a drive unit (41, 42, . . . ) for every data line. The two reference voltages (VRk, VRk+1) output by the D/A conversion part 30 and the low-order bits of the display data DG are input to each drive unit. The drive units of the data line drive part 40 respectively perform voltage division of the two reference voltages, based on the low-order bits of the display data DG, and output the generated grayscale voltages as data line drive voltages (SV1 to SVn). Note that the low-order bits of the display data DG are data indicating which grayscale voltages to generate, using the two reference voltages input to the data line drive part 40.

To give a specific example, grayscale voltages V0 to V3, for example, can be generated by performing voltage division of the reference voltages VR0 and VR1, such as shown with the following equations (1) to (3).

$$V0=VR0 \tag{1}$$

$$V1=VR0+(VR1-VR0)\times 1/4 \tag{2}$$

$$V2=VR0+(VR1-VR0)\times 1/2 \tag{3}$$

$$V3=VR0+(VR1-VR0)\times 3/4 \tag{4}$$

In this example, the low-order bits of the aforementioned display data DG indicate which grayscale voltages to generate out of the grayscale voltages V0 to V3.

5. Frame Rate Control

Next, frame rate control will be described. As aforementioned, with gradations on the low gradation region side and gradations on the high gradation region side, deviation in the gamma characteristics from other gradations often occurs, even with the same display panel.

Figure 8:
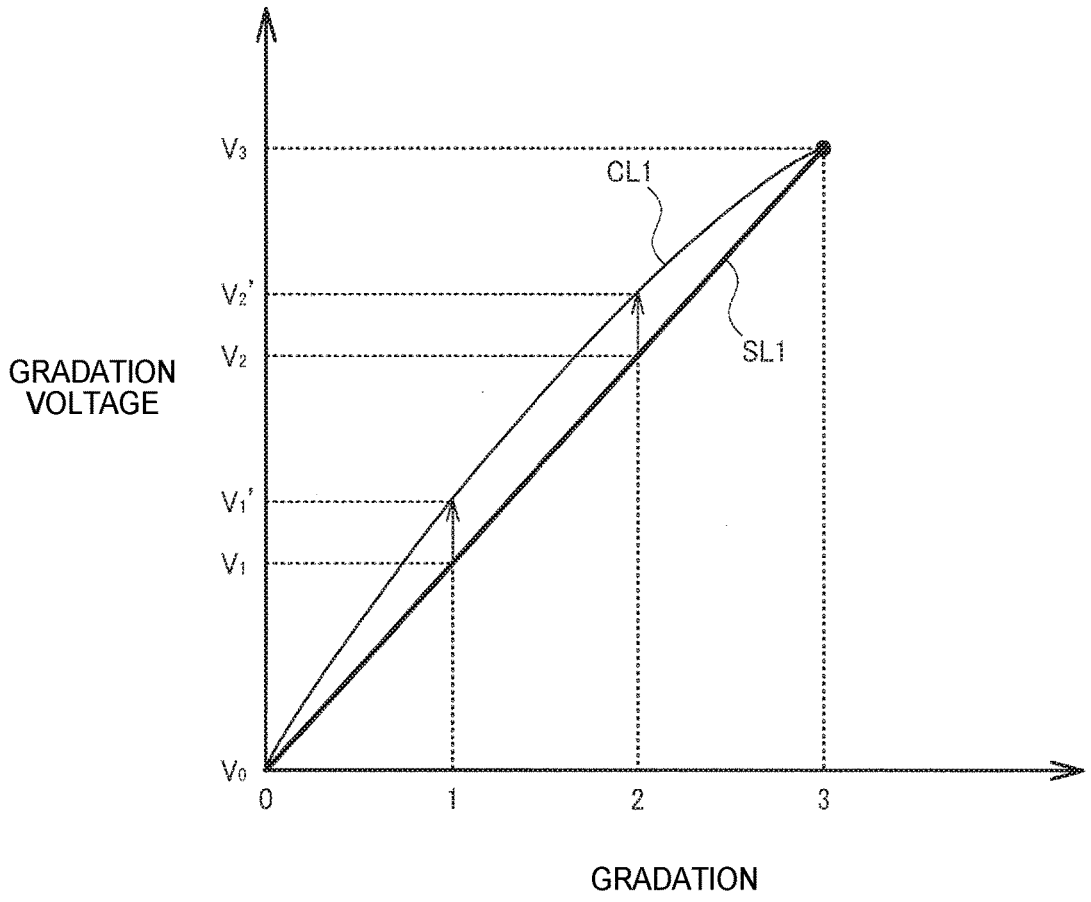
FIG. 8 is an explanatory diagram of the gradation characteristics of gradations on the low gradation region side.
Figure 9:
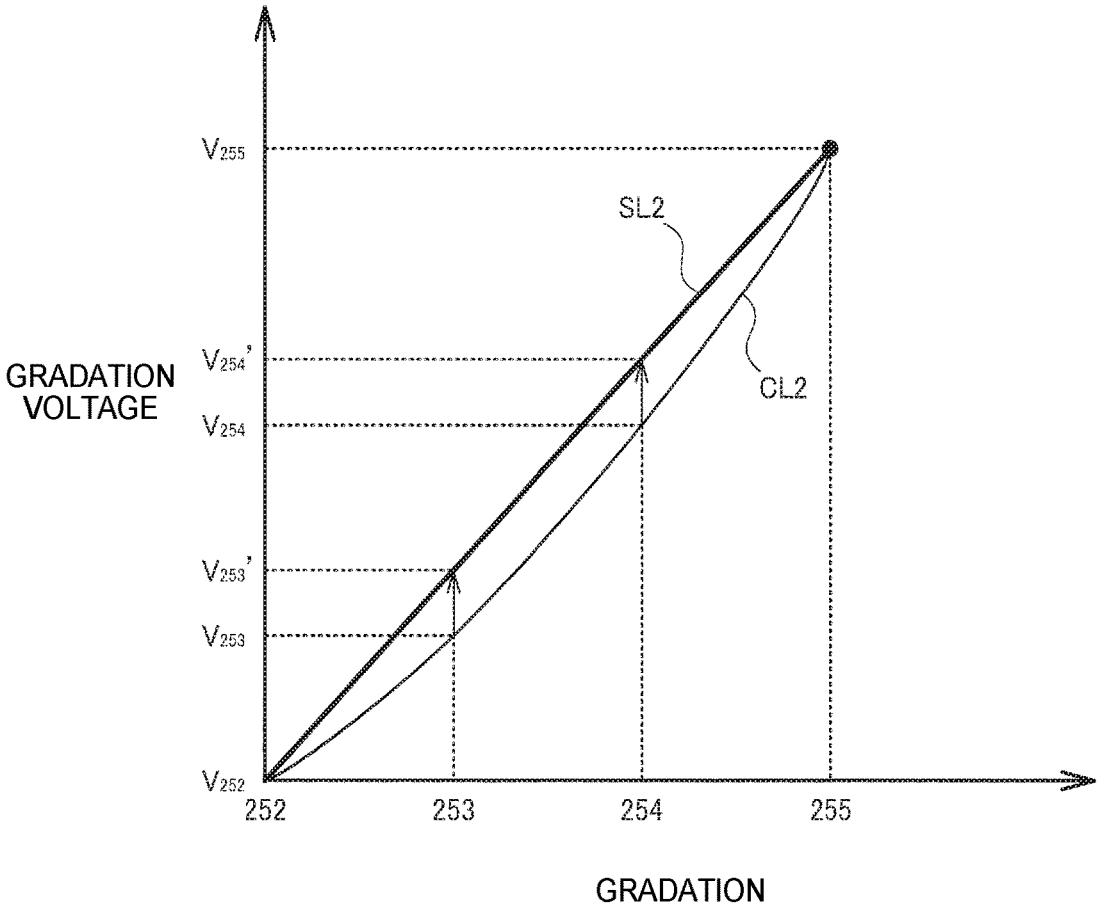
FIG. 9 is an explanatory diagram of the gradation characteristics of gradations on the high gradation region side.

Here, the relationship between gradations and grayscale voltages is shown in the graphs of FIG. 7 to FIG. 9. The graphs of FIG. 7 to FIG. 9 show gradation on the horizontal axis and show grayscale voltage on the vertical axis.

For example, with the gradations (0 to 3) on the low gradation region side, the drive circuit 110 needs to output grayscale voltages such as shown by a curve CL1 in FIG. 8, in order to suppress deviation in the gamma values from other gradations to within a given difference. However, in the case where gradations desired for display on the display panel are input directly to the drive circuit 110, grayscale voltages such as shown with a straight line SL1 in FIG. 8 will be output to the display panel. For example, in the example of FIG. 8, in order to display the gradation 1, it is desirable to output a voltage V1' as the grayscale voltage, but a voltage V1 that differs from the voltage V1' will be output. This is because, in the drive circuit 110, voltage division is performed linearly on the reference voltages to generate grayscale voltages, as shown with the aforementioned equations (1) to (4). As a result, the gamma characteristics will deviate from other gradations and color reproducibility and gradation will fall with gradations on the low gradation region side.

This similarly applies to the gradations (252 to 255) on the high gradation region side. As shown in FIG. 9, for example, in order to eliminate deviation in the gamma characteristics from other gradations, it is necessary to output grayscale voltages such as shown with a curve CL2 in FIG. 9, but in the case where gradations desired for display on the display panel are input directly to the drive circuit 110, grayscale voltages such as shown with a straight line SL2 of FIG. 9 will be output.

In view of this, in this embodiment, as aforementioned, the gradations are controlled by performing frame rate control on the gradations (0 to 3) on the low gradation region side and the gradations (252 to 255) on the high gradation region side, as shown in FIG. 7 to FIG. 9.

Frame rate control is, as aforementioned, performed using the look-up table circuit 25 that is included in the data processing part 20. In this case, a look-up table such as shown in FIG. 11, for example, can be used. Also, FIG. 10 shows a table of modulation patterns that are settable in the look-up table. FIG. 11 shows an example of the look-up table.

First, as shown in FIG. 10, in this embodiment, seven modulation patterns can be set, for example. For example, in the example of FIG. 10, the case of displaying the Nth gradation is illustrated. At this time, in the case where the setting 1 is selected, the control circuit 120 causes the drive circuit 110 to output a grayscale voltage VN−1 of the (N−1)th gradation in the first frame to the third frame, and a grayscale voltage VN corresponding to the Nth gradation in the fourth frame. Also, in the case where the setting 2 is selected, the control circuit 120 causes the drive circuit 110 to output a grayscale voltage VN−1 of the (N−1)th gradation in the first frame and the second frame, and a grayscale voltage VN corresponding to the Nth gradation in the third frame and the fourth frame. This similarly applies to the other settings 3 to 7.

In the example of FIG. 11, with the gradations (0 to 3) on the low gradation region side, the setting 4 in FIG. 10 is set for the gradation 0, the setting 7 is set for the gradation 1, the setting 6 is set for the gradation 2, and the setting 5 is set for the gradation 3. On the other hand, with the gradations (252 to 255) on the high gradation region side, the setting 4 in FIG. 10 is set for the gradation 252 and the gradation 255, the setting 2 is set for the gradation 253 and the setting 5 is set for the gradation 254.

This enables the grayscale voltages shown with the curve CL1 in FIG. 8 to be simulatively realized with gradations on the low gradation region side, and the grayscale voltages shown with the curve CL2 in FIG. 9 to be simulatively realized with gradations on the high gradation region side. To give a specific example, when representing the gradation 2, as shown in FIG. 8, for example, a state in which a grayscale voltage V2' is output can be simulatively reproduced, by outputting V2 and V3 to the display panel as the grayscale voltages at a given timing. This similarly applies to other examples.

Figure 12:
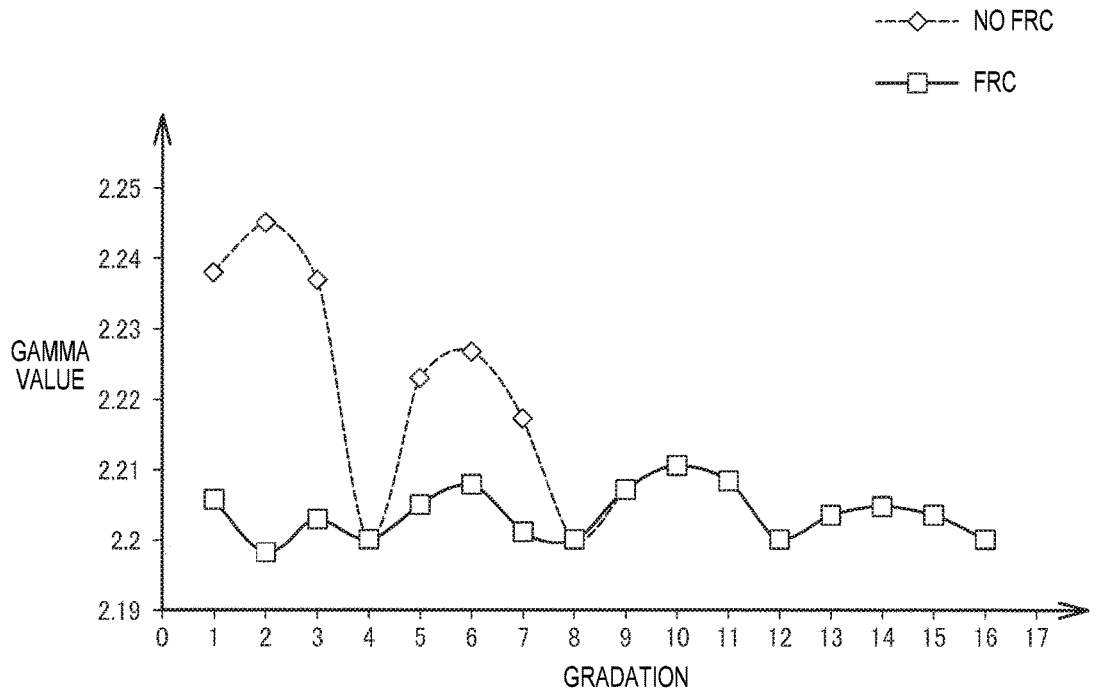
FIG. 12 is an explanatory diagram of gamma characteristics of gradations on the low gradation region side.
Figure 13:
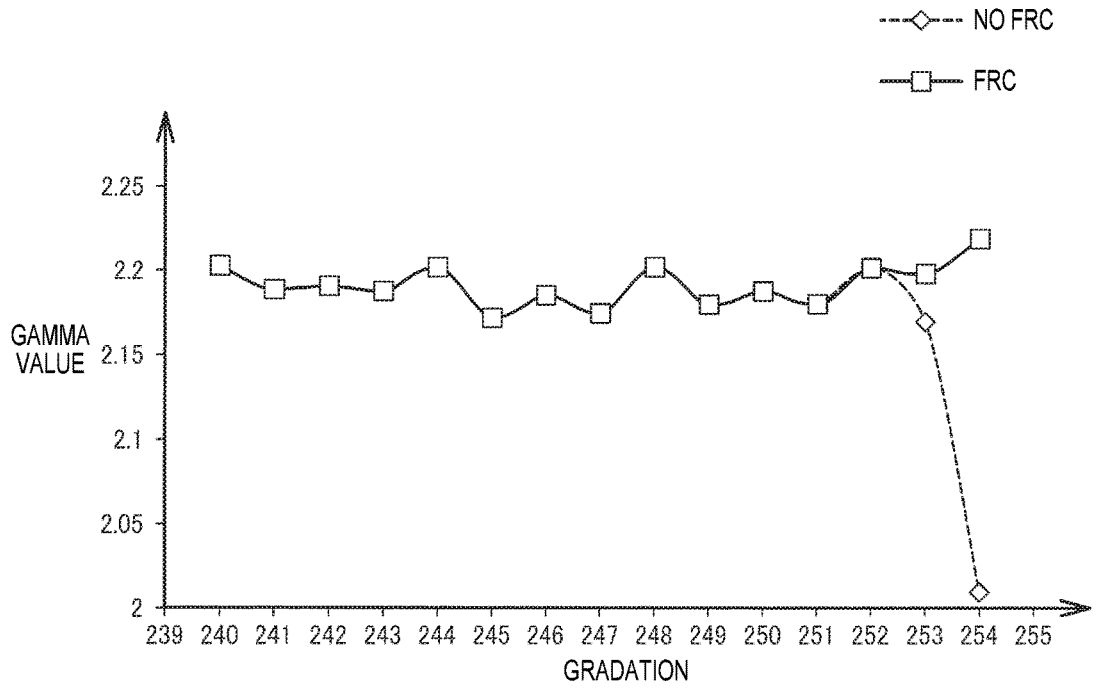
FIG. 13 is an explanatory diagram of gamma characteristics of gradations on the high gradation region side.

The results are shown in FIG. 12 and FIG. 13. The graph of FIG. 12 shows the change in the gamma values of gradations on the low gradation region side when frame rate control is not performed (no FRC) and when frame rate control is performed (FRC). The graph of FIG. 12 shows gradation on the horizontal axis and shows gamma value on the vertical axis. This similarly applies to FIG. 13.

As shown in FIG. 12, divergence of the gamma values from other gradations is marked in the gradations 0 to 3 without FRC, whereas the difference in gamma values from other gradations is eliminated with FRC.

Similarly, the graph of FIG. 13 shows the change in the gamma values of gradations on the high gradation region side. As shown in FIG. 13, divergence of the gamma values from other gradations is marked in the gradations 253 to 255 without FRC, whereas the difference in gamma values from other gradations is eliminated with FRC.

With gradations on the low gradation region side and gradations on the high gradation region side, deviation in the gamma characteristics can thereby be eliminated and color reproducibility and gradation can be improved. Note that, in this example, frame rate control is only performed on the gradations (0 to 3) on the low gradation region side and the gradations (252 to 255) on the high gradation region side, and frame rate control is not performed on the other gradations. The present embodiment is, however, not limited thereto, and frame rate control may also be performed on gradations other than the gradations on the low gradation region side and the gradations on the high gradation region side.

Also, as aforementioned, in this embodiment, rather than performing frame rate control in order to display new gradations, frame rate control is performed in order to correct gradations whose gamma characteristics deviate from other gradations, among the existing gradations.

6. Dual Gate

Figure 14:
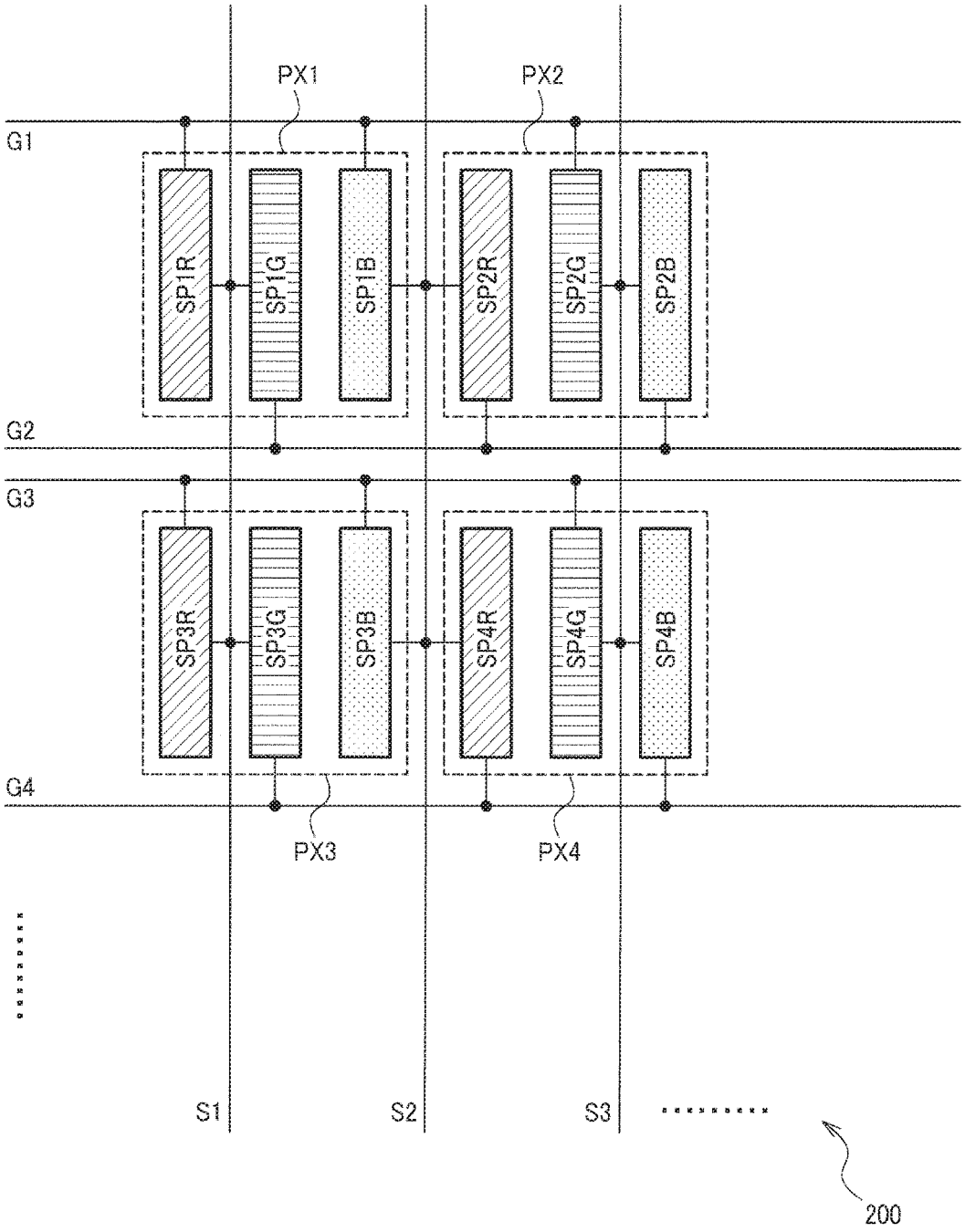
FIG. 14 is an explanatory diagram of a specific exemplary configuration of a display panel.

Next, the display panel that is used in this embodiment is illustrated to FIG. 14. In the following description, a dual gate display panel will be taken as an example, from among active-matrix display panels (e.g., TFT liquid crystal panels), but the invention can also be applied to display panels other than a dual gate display panel (e.g., single gate or triple gate display panel). Furthermore, the invention is not limited to a liquid crystal panel and can also be applied to a self-luminous light panel (e.g., organic EL panel) or the like.

The display panel that is used in this embodiment is, as shown in FIG. 14, a panel having a first pixel group (SP1R, SP1B, SP2G) that is selected by a first scanning line (first gate line) G1 and a second pixel group (SP1G, SP2R, SP2B) that is selected by a second scanning line (second gate line) G2, out of the first scanning line G1 and the second scanning line G2 provided in correspondence with the display lines, and in which each data line of a plurality of data lines (S1, S2, S3, . . . ) is shared by the pixels of the first pixel group and the pixels of the second pixel group.

FIG. 14 is an exemplary configuration of a color display panel that is driven by the display driver 100, and shows part of a pixel array. Pixels (picture elements) PX1 and PX2 are pixels of a first horizontal display line, and pixels PX3 and PX4 are pixels of a second horizontal display line. RGB subpixels are included in each pixel. For example, the pixel PX1 is constituted by a subpixel SP1R to which a color filter of a first color (R) is provided, a subpixel SP1G to which a color filter of a second color (G) is provided, and a subpixel SP1B to which a color filter of a third color (B) is provided.

The data lines are connected in common to two subpixels in each horizontal display line. For example, in the first horizontal display line, the data line S1 is connected to the subpixels SP1R and SP1G, and the data line S2 is connected to the subpixels SP1B and SP2R. Two gate lines are provided for each horizontal display line. One of the two gate lines is connected to one of the two subpixels that are connected to one data line, and the other of the two gate lines is connected to the other of the two subpixels that are connected to one data line. For example, the gate lines G1 and G2 are provided for the first horizontal display line, with the gate line G1 being connected to the subpixel SP1R and the gate line G2 being connected to subpixel SP1G out of the subpixels SP1R and SP1G that are connected to the data line S1.

Also, in the horizontal scanning period for driving the first horizontal display line, for example, the display driver 100, in that horizontal scanning period, selects the gate lines G1 and G2 in time division. The grayscale voltages of the subpixels SP1R, SP1B and SP2G are then output to the data lines S1, S2 and S3 in the period in which the gate line G1 is selected, and writing to the subpixels SP1R, SP1B and SP2G is performed. The grayscale voltages of the subpixels SP1G, SP2R and SP2B are output to the data lines S1, S2 and S3 in the period in which the gate line G2 is selected, and writing to the subpixels SP1G, SP2R, and SP2B is performed.

That is, in this display driver 100, the interface part 10 accepts RGB display data RD, GD and BD, the data processing part 20 outputs RGB display data RQ1, GQ1 and BQ1, and the drive circuit 110 writes the grayscale voltages corresponding thereto to the subpixels SP1R, SP1G and SP1B of the pixel PX1. The RGB grayscale voltages are thus written to the respective pixels, and a color image is displayed on the display panel.

Note that, display data RQ1, GQ1 and BQ1 are data that are output from the data processing part 20, and respectively correspond to pixels or subpixels of the display panel. For example, in the case of the color display panel of FIG. 14, the display data RQ1, GQ1 and BQ1 correspond to the subpixel SP1R of the first color (red), the subpixel SP1G of the second color (green), and the subpixel SP1B of the third color (blue) of the pixel PX1.

By using such a display panel, it becomes possible to, for instance, reduce the number of the data lines of the display panel. Note that the configuration of the pixel array in the dual gate display panel is not limited to FIG. 14. For example, with the subpixels SP1R, SP1G, SP1B and SP2R, the subpixels SP1R and SP2R may be connected to the gate line G1 (first pixel group), and the subpixels SP1G and SP1B may be connected to the gate line G2 (second pixel group). Alternatively, with the subpixels SP1R, SP1G, SP3R and SP3G, the subpixels SP1R and SP3G may be connected to the gate lines G1 and G3, and subpixels SP1G and SP3R may be connected to the gate lines G2 and G4. Note that various modifications can also be additionally implemented. For example, the technique of this embodiment can also be applied to a display panel employing a RGBW method that adds W (white) pixels to the RGB pixels.

7. Modifications

Figure 15:
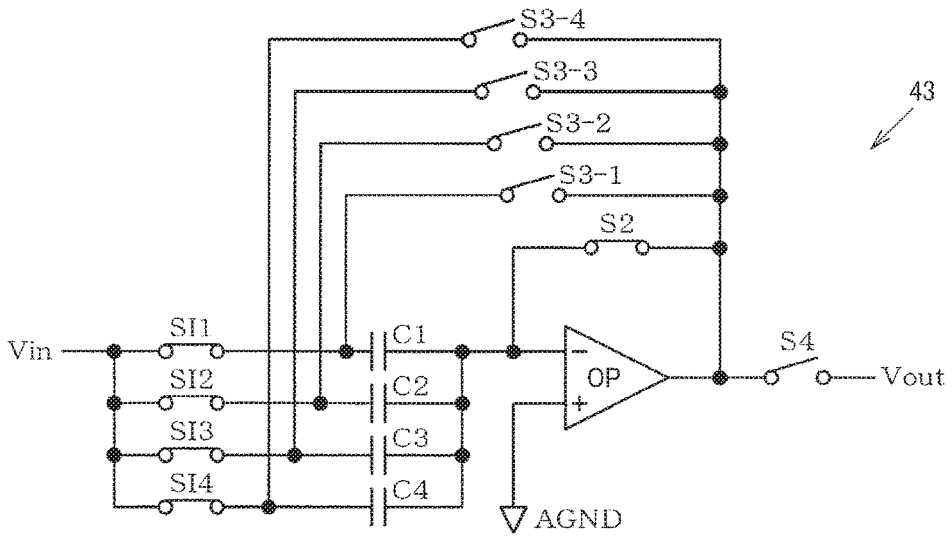
FIG. 15 is an exemplary configuration of a drive unit.

Next, modifications of this embodiment will be described. FIG. 6 shows an exemplary configuration for simultaneously inputting two reference voltages (VR(K+1), VRK) from the D/A conversion part 30 respectively to the drive parts 41 and 42, but this embodiment is not limited thereto. For example, a modification for inputting two reference voltages in time division from the D/A conversion part 30 is also possible. FIG. 15 shows an exemplary configuration of the drive unit 43 in this modification.

The drive unit 43 is a so-called flip-around sample and hold circuit, and includes an operational amplifier OP, capacitors C1, C2, C3 and C4, and switching elements SI1, SI2, SI3, SI4, S2, S3-1, S3-2, S3-3, S3-4 and S4. An input voltage Vin (reference voltage) from the D/A conversion part 30 is input to one end of the switching elements SI1 to SI4. The other end of the switching elements SI1 to SI4 is connected to one end of the capacitors C1 to C4. The other end of the capacitors C1 to C4 is connected to an inverting input terminal of the operational amplifier OP. The inverting input terminal of the operational amplifier OP is set to AGND. The switching element S2 is provided between the inverting input terminal and an output terminal of the operational amplifier OP. The switching elements S3-1, S3-2, S3-3 and S3-4 are provided between the nodes of one end of the capacitors C1 to C4 and the output terminal of the operational amplifier OP. The switch element S4 is provided between the output terminal of the operational amplifier OP and an output node of a grayscale voltage VOUT.

Figure 16:
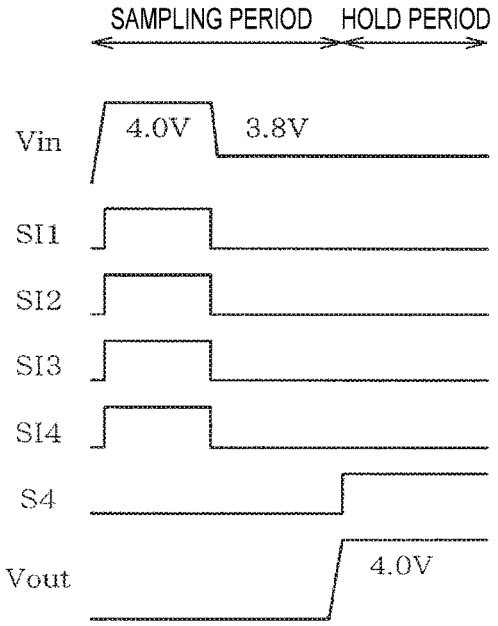
FIG. 16 is an explanatory diagram of a first exemplary operation of the drive unit.
Figure 17:
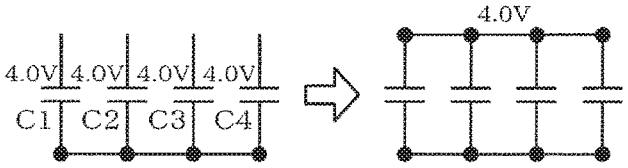
FIG. 17 is an explanatory diagram of the first exemplary operation of the drive unit.

FIG. 16 and FIG. 17 are explanatory diagrams of a first exemplary operation of the drive unit 43. In FIG. 16 and FIG. 17, an example is shown in which 4.0V is output as the grayscale voltage between the first and second reference voltages (VR(K+1), VRK) when the low-order 2 bits of the display data DG are "00". As shown in FIG. 16, in the case where 4.0V is provided as the first reference voltage (VR (K+1)) and 3.8V is provided as the second reference voltage (VRK) in the sampling period, 4.0V is supplied to all of the capacitors C1 to C4, via the switching elements SI1 to SI4 for use in input. That is, in the first half of the sampling period in which the first reference voltage (4.0V) is supplied, all the switching elements SI1 to SI4 are turned ON, whereas in the second half of the sampling period in which the second reference voltage (3.8V) is supplied, all of the switching elements SI1 to SI4 are turned OFF. As shown in FIG. 17, in the hold period, 4.0V can then be output as the grayscale voltage Vout, by supplying an electric charge to the output terminal side of the operational amplifier OP via the switching elements S3-1 to S3-4 for use in flip-around.

Note that, in the sampling period, the switching element S2 for use in feedback is turned ON and the switching element S4 is turned OFF, and, in the hold period, the switching element S2 is turned OFF and the switching element S4 is turned ON. Also, ON/OFF control of the switching elements SI1 to SI4 is performed based on the low-order bits of the display data DG.

Figure 18:
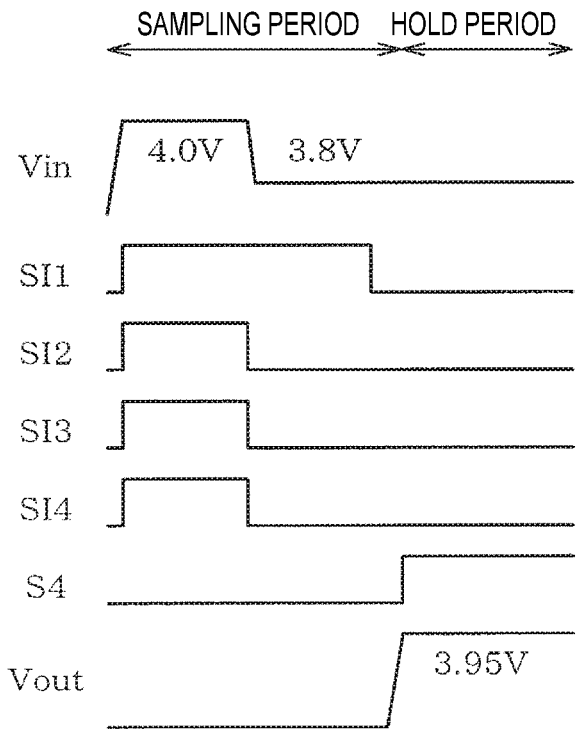
FIG. 18 is an explanatory diagram of a second exemplary operation of the drive unit.
Figure 19:
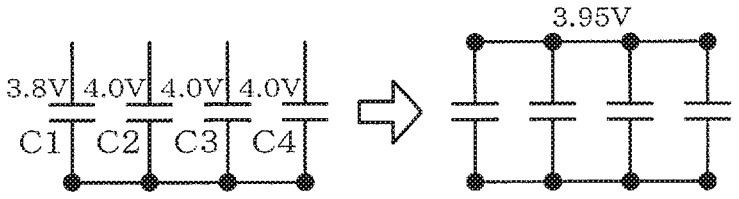
FIG. 19 is an explanatory diagram of the second exemplary operation of the drive unit.

FIG. 18 and FIG. 19 are explanatory diagrams of a second exemplary operation of the drive unit 43. In FIG. 18 and FIG. 19, an example is shown in which 3.95V is output as the grayscale voltage between the first and second reference voltages (VR(K+1), VRK) when the low-order 2 bits of the display data DG are "01". As shown in FIG. 18, in the case of providing 4.0V as the first reference voltage (VR(K+1)) and 3.8V as the second reference voltage (VRK) in the sampling period, 4.0V is supplied to three capacitors out of the capacitors C1 to C4, and 3.8V is supplied to the one remaining capacitor, via the switching elements SI1 to SI4. That is, in the first half of the sampling period in which the first reference voltage (4.0V) is supplied, all of the switching elements SI1 to SI4 are turned ON, whereas in the second half of the sampling period in which the second reference voltage (3.8V) is supplied, only the switching element SI1 is turned ON. As shown in FIG. 19, in the hold period, 3.95V can then be output as the grayscale voltage Vout, by supplying an electric charge to the output terminal side of the operational amplifier OP via switching elements S3-1 to S3-4.

Figure 20:
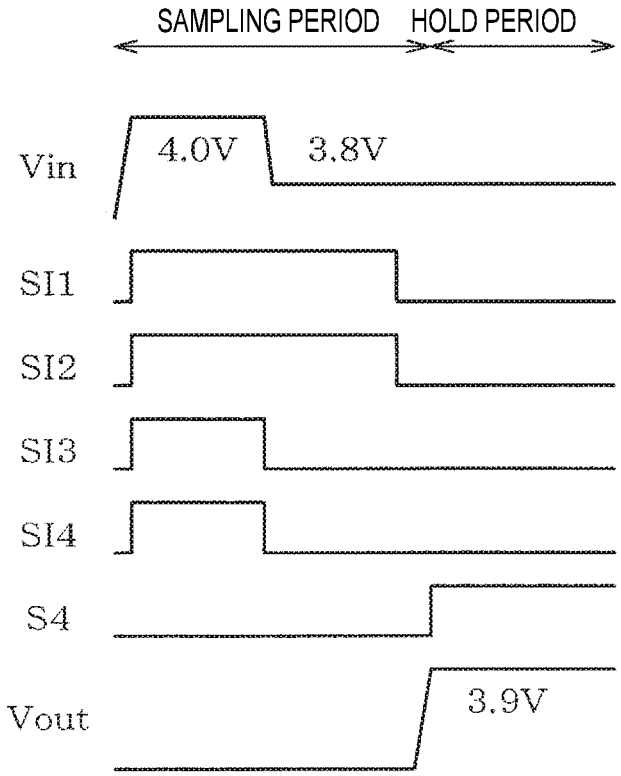
FIG. 20 is an explanatory diagram of a third exemplary operation of the drive unit.
Figure 21:
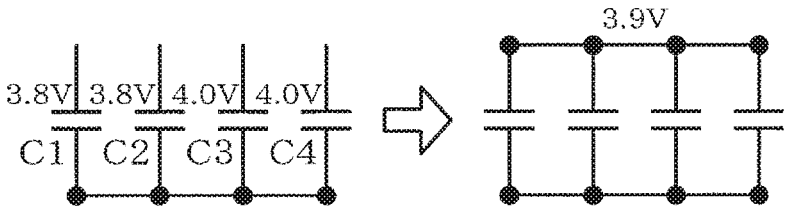
FIG. 21 is an explanatory diagram of the third exemplary operation of the drive unit.

FIG. 20 and FIG. 21 are explanatory diagrams of a third exemplary operation of the drive unit 43. In FIG. 20 and FIG. 21, an example is shown in which 3.9V is output as the grayscale voltage between the first and second reference voltages (VR(K+1), VRK) when the low-order 2 bits of the display data DG are "10". As shown in FIG. 18, in the case where 4.0V is provided as the first reference voltage (VR (K+1)) and 3.8V is provided as the second reference voltage (VRK) in the sampling period, 4.0V is supplied to two capacitors out of the capacitors C1 to C4, and 3.8V is supplied to the remaining two capacitors, via the switching elements SI1 to SI4. That is, in the first half of the sampling period in which the first reference voltage (4.0V) is supplied, all of the switching elements SI1 to SI4 are turned ON, whereas in second half of the sampling period in which the second reference voltage (3.8V) is supplied, only the switching elements SI1 and SI2 are turned ON. As shown in FIG. 21, in the hold period, 3.9V can then be output as the grayscale voltage Vout, by supplying an electric charge to the output terminal side of the operational amplifier OP via the switching elements S3-1 to S3-4.

Also, as a modification of this embodiment, a configuration may be adopted in which the frame rate control of this embodiment is performed in the case where the input data (image data, display data) of the interface part 10 and the like of FIG. 3 is 8 bits, for example, and the frame rate control of this embodiment is not performed in the case where the input data is 6 bits or less. That is, ON/OFF of the frame rate control is controlled, according to the format (8 bit, 6 bit, etc.) of the input data.

Also, a configuration may be adopted in which the frame rate control of this embodiment is performed, in the case where the input data is graphics image data, and the frame rate control of this embodiment is not performed, in the case where the input data is character data or the like. For example, in the case of graphics image data such as illustrations, figures, photographs and the like, display quality can be improved by turning the frame rate control of this embodiment ON. On the other hand, in the case of character data and the like, the frame rate control is turned OFF since the display quality required is not so high.

8. Electro-Optic Apparatus and Electronic Device

FIG. 22 shows an exemplary configuration of an electro-optic apparatus and an electronic device to which the display driver 100 of this embodiment can be applied. Various electronic devices that are installed in a display apparatus, such as an in-vehicle display apparatus (e.g., meter panel, etc.), a monitor, a display, a single-panel projector, a television apparatus, an information processing apparatus (computer), a personal digital assistant, a car navigation system, a portable game terminal, a DLP (Digital Light Processing)

apparatus, a printer and the like, for example, can be envisioned as the electronic device of this embodiment.

The electronic device shown in FIG. 22 includes an electro-optic apparatus 350, a CPU 310 (broadly, processing apparatus), a display controller 300 (host controller), a storage part 320, a user interface part 330, and a data interface part 340. The electro-optic apparatus 350 includes the display driver 100 and the display panel 200.

The display panel 200 is a matrix liquid crystal display panel. Alternatively, the display panel 200 may be an EL (Electro-Luminescence) display panel that uses a self-luminous light element. For example, the display panel 200 is formed as a glass substrate, and the display driver 100 is mounted on the glass substrate. The electro-optic apparatus 350 is constituted as a module including the display panel 200 and the display driver 100 (display controller 300 may be further included in the electro-optic apparatus 350). Note that the display controller 300 and the display driver 100 may be incorporated into an electronic device as individual components, rather than being constituted as a module.

The user interface part 330 is an interface part that accepts various user operations. For example, the user interface part 330 is constituted by buttons, a mouse, a keyboard, a touch panel mounted on the display panel 200, and the like. The data interface part 340 is an interface part that performs input/output of image data and control data. For example, the data interface part 340 is a wired communication interface such as a USB or a wireless communication interface such as wireless LAN. The storage part 320 stores image data input from the data interface part 340. Alternatively, the storage part 320 functions as a working memory of the CPU 310 and the display controller 300. The CPU 310 performs processing for controlling the various parts of the electronic device and various data processing. The display controller 300 performs processing for controlling the display driver 100. For example, the display controller 300 converts image data transmitted from the data interface part 340 or the storage part 320 via the CPU 310 into a form acceptable by the display driver 100, and outputs the converted image data to the display driver 100. The display driver 100 drives the display panel 200 based on the image data transferred from the display controller 300.

The above embodiment can be applied to a control method for the display driver 100 that utilizes frame rate control on first display data corresponding to a grayscale voltage obtained by voltage division of a first reference voltage and a second reference voltage, out of a first reference voltage to a nth reference voltage (where n is an integer of two or more) to generate second display data, and outputs a drive voltage that is based on the second display data, in the case of outputting a drive voltage that is based on the grayscale voltage obtained by voltage division of the first reference voltage and the second reference voltage.

Also, with the control method for the display driver 100 of this embodiment, frame rate control may be utilized on first display data corresponding to a grayscale voltage obtained by voltage division of an (n−1)th reference voltage and an nth reference voltage to generate second display data, and a drive voltage that is based on the second display data may be output, in the case of outputting a drive voltage that is based on the grayscale voltage obtained by voltage division of the (n−1)th reference voltage and the nth reference voltage.

Although this embodiment has been described in detail above, a person skilled in the art will appreciate that numerous modifications can be made without substantially departing from the novel matter and effects of the invention. Accordingly, all such modifications are intended to be embraced within the scope of the invention. For example, terms that appear in the description or drawings at least once together with other broader or synonymous terms can be replaced by those other terms in any part of the description or drawings. Also, the configurations and operations of the display driver, the electro-optic apparatus and the electronic device are not limited to those described in this embodiment, and various modifications can be made.

What is claimed is:

1. A display driver comprising:

a drive circuit that receives input of a first reference voltage to an nth reference voltage (where n is an integer of two or more), and outputs a drive voltage that is based on a grayscale voltage obtained by voltage division of an ith reference voltage and an (i+1)th reference voltage (where i is an integer of n−1 or less); and a control circuit that utilizes frame rate control on first display data corresponding to a grayscale voltage out of a plurality of grayscale voltages, the plurality of grayscale voltages being obtained by voltage division of the first reference voltage and a second reference voltage to generate second display data, and supplies the second display data to the drive circuit, wherein a number of the plurality of grayscale voltages obtained by voltage division of the first reference voltage and the second reference voltage is greater than two, wherein the first reference voltage and the second reference voltage are from a plurality of reference voltages, and a number of reference voltages in the plurality of reference voltages is greater than two, and wherein high-order bits determine which reference voltage to use for the first reference voltage and the second reference voltage, and the voltage division of the first reference voltage and the second reference voltage is based on low-order bits.

2. The display driver according to claim 1, wherein the drive circuit outputs a drive voltage that is based on the second display data, in a case of outputting a drive voltage that is based on the grayscale voltage obtained by voltage division of the first reference voltage and the second reference voltage.

3. The display driver according to claim 1, wherein the control circuit utilizes the frame rate control on first display data corresponding to a grayscale voltage obtained by voltage division of an (n−1)th reference voltage and the nth reference voltage to generate the second display data, and supplies the second display data to the drive circuit.

4. The display driver according to claim 3, wherein the drive circuit outputs the drive voltage that is based on the second display data, in a case of outputting a drive voltage that is based on the grayscale voltage obtained by voltage division of the (n−1)th reference voltage and the nth reference voltage.

5. The display driver according to claim 1, wherein the control circuit includes a look-up table circuit that outputs the second display data, based on a look-up table to which the first display data is input.

6. An electro-optic apparatus comprising the display driver according to claim 1.

7. An electronic device comprising the display driver according to claim 1.

8. A control method for a display driver comprising:

utilizing, with a control circuit, frame rate control on first display data corresponding to a grayscale voltage obtained by voltage division of a first reference voltage and a second reference voltage, out of the first reference voltage to an nth reference voltage (where n is an integer of two or more), to generate second display data; and outputting, with a drive circuit, a drive voltage that is based on the second display data, in a case of outputting a drive voltage that is based on the grayscale voltage out of a plurality of grayscale voltages, the plurality of grayscale voltages being obtained by voltage division of the first reference voltage and the second reference voltage, wherein a number of the plurality of grayscale voltages obtained by voltage division of the first reference voltage and the second reference voltage is greater than two, wherein the first reference voltage and the second reference voltage are from a plurality of reference voltages, and a number of reference voltages in the plurality of reference voltages is greater than two, and wherein high-order bits determine which reference voltage to use for the first reference voltage and the second reference voltage, and the voltage division of the first reference voltage and the second reference voltage is based on low-order bits.

9. The control method for a display driver according to claim 8, wherein the frame rate control is utilized on first display data corresponding to a grayscale voltage obtained by voltage division of an (n−1)th reference voltage and the nth reference voltage to generate the second display data; and the drive voltage that is based on the second display data is output, in a case of outputting a drive voltage that is based on the grayscale voltage obtained by voltage division of the (n−1)th reference voltage and the nth reference voltage.

10. A display driver comprising:

a control circuit that utilizes frame rate control on first display data corresponding to a grayscale voltage obtained by voltage division of a first reference voltage and a second reference voltage, out of the first reference voltage to an nth reference voltage (where n is an integer of two or more), to generate second display data; and a drive circuit that outputs a drive voltage that is based on the second display data, in a case of outputting a drive voltage that is based on the grayscale voltage out of a plurality of grayscale voltages, the plurality of grayscale voltages being obtained by voltage division of the first reference voltage and the second reference voltage, and wherein a number of the plurality of grayscale voltages obtained by voltage division of the first reference voltage and the second reference voltage is greater than two, wherein the first reference voltage and the second reference voltage are from a plurality of reference voltages, and a number of reference voltages in the plurality of reference voltages is greater than two, and wherein high-order bits determine which reference voltage to use for the first reference voltage and the second reference voltage, and the voltage division of the first reference voltage and the second reference voltage is based on low-order bits.

* * * * *